US009702143B2

(12) United States Patent
Perez et al.

(10) Patent No.: US 9,702,143 B2
(45) Date of Patent: Jul. 11, 2017

(54) ACOUSTIC PANEL

(71) Applicant: Stillpoints LLC, Hudson, WI (US)

(72) Inventors: Alfonso E. Perez, New Brighton, MN (US); Paul J. Wakeen, Woodville, WI (US); David R. Hallquist, River Falls, WI (US)

(73) Assignee: Stillpoints LLC, Hudson, WI (US)

( * ) Notice: Subject to any disclaimer, the term of this patent is extended or adjusted under 35 U.S.C. 154(b) by 0 days.

(21) Appl. No.: 14/510,753

(22) Filed: Oct. 9, 2014

(65) Prior Publication Data

US 2015/0096832 A1 Apr. 9, 2015

Related U.S. Application Data

(60) Provisional application No. 61/889,000, filed on Oct. 9, 2013.

(51) Int. Cl.

| | |
|---|---|
| ***E04B 1/86*** | (2006.01) |
| *E04B 1/82* | (2006.01) |
| *E04B 1/84* | (2006.01) |

(52) U.S. Cl.

CPC ..... *E04B 1/86* (2013.01); *E04B 2001/8263* (2013.01); *E04B 2001/8433* (2013.01); *E04B 2001/8452* (2013.01)

(58) Field of Classification Search

CPC ..... E04B 2001/8263; E04B 2001/8433; E04B 2001/8452; E04B 2001/8272

USPC ..... 181/287, 290, 210

See application file for complete search history.

(56) References Cited

U.S. PATENT DOCUMENTS

| | | | | |
|---|---|---|---|---|
| 2,884,084 | A | 4/1959 | Sussman | |
| 3,592,288 | A * | 7/1971 | Walter | E04B 1/8227 160/351 |
| 3,948,347 | A | 4/1976 | Rutledge | |
| 4,276,954 | A * | 7/1981 | Romano | E06B 7/084 160/236 |
| 4,423,574 | A * | 1/1984 | Pierre | E06B 9/02 49/63 |
| 4,611,444 | A * | 9/1986 | Nassof | E04B 9/001 181/290 |
| 4,702,046 | A * | 10/1987 | Haugen | E04B 1/10 181/286 |
| 4,769,965 | A * | 9/1988 | Shaub | E04B 9/241 52/506.07 |
| 4,901,485 | A * | 2/1990 | Menchetti | E04B 9/0428 181/291 |
| 5,009,043 | A | 4/1991 | Kurrasch | |
| 6,158,176 | A * | 12/2000 | Perdue | E04B 1/86 181/284 |
| 6,260,325 | B1 * | 7/2001 | Wendt | E04B 9/068 52/489.2 |
| 6,321,871 | B1 | 11/2001 | Russell | |

(Continued)

FOREIGN PATENT DOCUMENTS

| | | |
|---|---|---|
| EP | 2458090 | 5/2012 |

*Primary Examiner* — Jeremy Luks

(74) *Attorney, Agent, or Firm* — Vidas, Arrett & Steinkraus

(57) ABSTRACT

An acoustic panel device includes a panel member and a mount. The panel member includes a porous material. The mount is arranged to captively support the panel member. The mount can be a frame that surrounds the panel member. The frame can define a channel, and a portion of the panel member is disposed in the channel.

20 Claims, 7 Drawing Sheets

(56) References Cited

U.S. PATENT DOCUMENTS

| | | | | |
|---|---|---|---|---|
| 7,440,582 | B2 | 10/2008 | Hager et al. | |
| 7,721,847 | B2 | 5/2010 | Coury | |
| 2006/0145376 | A1 | 7/2006 | Hager et al. | |
| 2008/0029336 | A1 | 2/2008 | Sigler et al. | |
| 2012/0285767 | A1* | 11/2012 | Meyer | E04B 1/8209 181/286 |
| 2015/0008070 | A1* | 1/2015 | Caimi | E04B 1/86 181/290 |

* cited by examiner

ACOUSTIC PANEL

CROSS-REFERENCE TO RELATED APPLICATIONS

This application claims priority to U.S. Provisional Patent Application No. 61/889,000, filed on Oct. 9, 2013, the entire disclosure of which is hereby incorporated herein by reference.

BACKGROUND OF THE INVENTION

This invention relates to acoustics and acoustic treatments, which desirably improve the sonic characteristics of a space.

Various types of acoustic treatments are known in the art. Sound panels, sound deadeners, dampers, bass traps, diffusers, baffles and the like are used in various applications to control sound and noise. While each type of product has certain strengths, each also has certain weaknesses.

There remains a need for acoustic treatments of novel design that provide superior sonic results. Desirably, such acoustic treatments can have smaller dimensions, lower cost, etc., when compared to known treatment methods.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an acoustic panel comprises a mount and a panel member. The mount is suitable for attachment to a supporting surface. The panel member comprises a porous material. The mount is arranged to captively support the panel member.

In some embodiments, an acoustic panel comprises a frame and a panel member. The panel member comprises a porous material. The frame member surrounds the panel member. The frame is arranged to captively support the panel member.

In some embodiments, the frame comprises a channel, a portion of the panel member is disposed in said channel.

In some embodiments, the panel member comprises a structural member attached to the porous material, and the frame captively supports the structural member.

In some embodiments, the panel member comprises a scrim layer attached to the porous material.

In some embodiments, the frame comprises a sealed rear cavity.

In some embodiments, an acoustic panel further comprises a second panel member captively supported by the frame.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
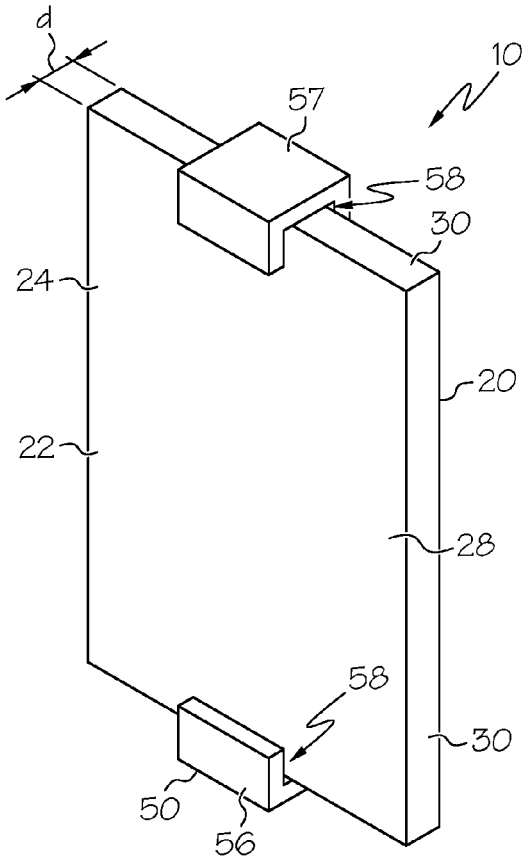
FIG. 1 shows an embodiment of an acoustic panel.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the Figures shall refer to like features unless otherwise indicated.

Figure 2:
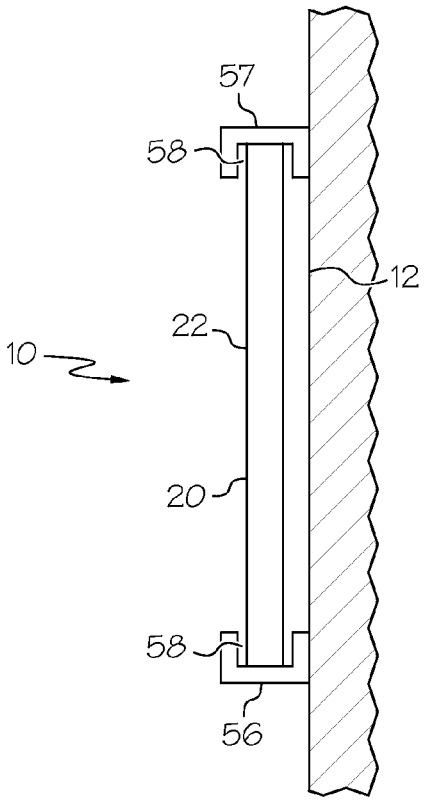
FIG. 2 shows a side view of the acoustic panel of FIG. 1.

FIG. 1 shows an embodiment of an acoustic panel 10. FIG. 2 shows a side view of the acoustic panel 10 attached to a supporting surface 12, such as a wall. In some embodiments, an acoustic panel 10 comprises a panel member 20 and a mount 50. Desirably, the panel member 20 comprises a porous material, such as fiberglass. Desirably, the mount 50 is constructed and arranged to be attached to a supporting surface 12, such as a wall or a stand. Desirably, the mount 50 is constructed and arranged to captively support the panel member 20 while allowing some movement between the mount 50 and the panel member 20. This freedom of movement allows the panel member 20 to vibrate in response to acoustic vibrations—thus, in some embodiments, the acoustic panel 10 comprises both a porous material absorber and a vibrating panel absorber. This allows the acoustic panel 10 to absorb sound better than either a fixed porous material or a solid vibrating panel.

Figure 12:
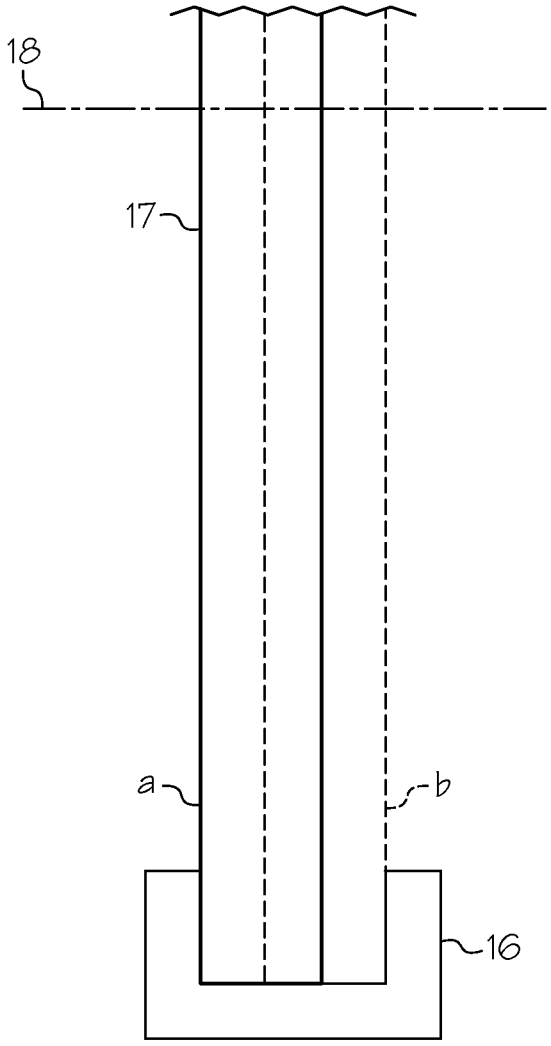
FIG. 12 shows a schematic drawing showing one object captively supported by another object.

As used herein, the term "captive support" or "captively supported" means that a first object, such as a mount 50 or frame, provides support for another object, such as a panel member 20, wherein the engagement allows some relative movement between the first object and the second object. For example, FIG. 12 shows an example of a second object 17 that is captively supported along axis 18 by a first object 16. The second object 17 can move along axis 18 between a first position a and a second position b. The captive support provided by the first object 16 prevents the second object 17 from moving along axis 18 beyond either of the first or second positions a, b, but the first object 16 does not restrict movement of the second object 17 between the first and second positions a, b. In the instance of captively supported panels, desirably the support allows for movement at least in a direction orthogonal to a front face of the panel; however, in some embodiments, the support can allow for movement along two orthogonal axes, and in some embodiments, the support allows for movement along three orthogonal axes. Desirably, the captive support provides for a range of motion at least equal to an amount of motion that would be experienced by the panel member 20 as it moves in response to acoustical energy.

As shown in FIG. 1, in some embodiments, the mount 50 comprises a bracket 56. In some embodiments, a bracket 56 is positioned under a portion of the panel member 20. Thus, the panel member 20 can rest on the bracket 56 due to gravity. In some embodiments, the bracket 56 comprises a cavity 58, slot or the like, and a portion of the panel member 20 is received in the cavity 58. In some embodiments, the panel member 20 comprises a predetermined depth d, and a corresponding dimension (e.g. width) of the cavity 58 is greater than the depth d of the panel member 20. Thus, the panel member 20 is captively supported by the bracket 56 and allowed some freedom to vibrate and move with respect to the bracket 56 in response to acoustical energy.

In some embodiments, a second bracket 57 is provided as a part of the mount 50. In some embodiments, first and second brackets 56, 57 are positioned on opposite sides of the panel member 20. As shown in FIGS. 1 and 2, the first and second brackets 56, 57 are positioned below and above the panel member 20.

The panel member 20 can comprise any suitable porous material. In various embodiments, a panel member 20 can comprise fiberglass, foam material(s), rock-wool, horse hair, cotton, steel wool, bagasse fibers or any other suitable porous material. In some embodiments, the panel member 20 comprises a fiberglass having a density range of 4-8 pounds per cubic foot. In some embodiments, the panel member 20 comprises a fiberglass having a density of 6-7 pounds per cubic foot. In some embodiments, the panel member 20 comprises a molded fiberglass core 28 comprising glass fibers in a binder, such as thermosetting resin. In some embodiments, the porous material of the panel member 20 is dimensionally stable. The specific size of the panel member 20 and density of the porous material can be adjusted as desired according to the needs of the particular application. For example, a panel member 20 for use an audio listening room may be different from a panel member 20 for use in an auditorium or stadium. In various embodiments, a panel member 20 can have any suitable dimensions. In some embodiments, a panel member 20 can have a thickness ranging from ½" to 4" or more. In some embodiments, a panel member 20 can have a length and/or width ranging from 6" to 10 feet or more.

A panel member 20 can have any suitable shape. In some embodiments, a panel member 20 is rectangular. In some embodiments, a panel member 20 is circular.

In some embodiments, the panel member 20 comprises a scrim 22 layer, for example applied to a surface of the panel member 20. In some embodiments, a scrim 22 layer is laminated to the porous material of the panel member 20. A scrim 22 can comprise fibers, such as glass fibers or carbon fibers, arranged to reinforce the panel member 20. In some embodiments, a scrim 22 layer comprises a fabric that can be applied (e.g. attached, wrapped, etc.) to any suitable number of surfaces of the panel member 20. In some embodiments, a scrim 22 layer helps to mask the color of the panel member 20. In some embodiments, a front face 24 of the panel member 20 comprises a scrim 22 layer. In some embodiments, sides 30 of the panel member 20 do not include a scrim 22 layer. In some embodiments, a density of the scrim 22 material is greater than a density of the porous material used to form the panel member 20. In some embodiments, a density of the scrim 22 material is at least twice the density of the porous material used to form the panel member 20. In some embodiments, a density of the scrim 22 material is 16-20 pounds per cubic foot. In some embodiments, a scrim 22 layer has a thickness of 1/16" or less. In some embodiments, a scrim 22 layer has a thickness of 1/32" or less. In some embodiments, a scrim 22 layer has a thickness of approximately 1/64".

It has been found that a panel member 20 comprising a porous material core of a given thickness, and having a scrim 22 layer, provides sound absorption similar to that of a porous material core of substantially greater thickness. For example, a porous material core having a scrim 22 layer can provide sound absorption similar to a porous material core of twice the thickness. Thus, provision of a scrim 22 layer can substantially reduce the required thickness of the panel member 20, and that of the acoustic panel 10.

Figure 3:
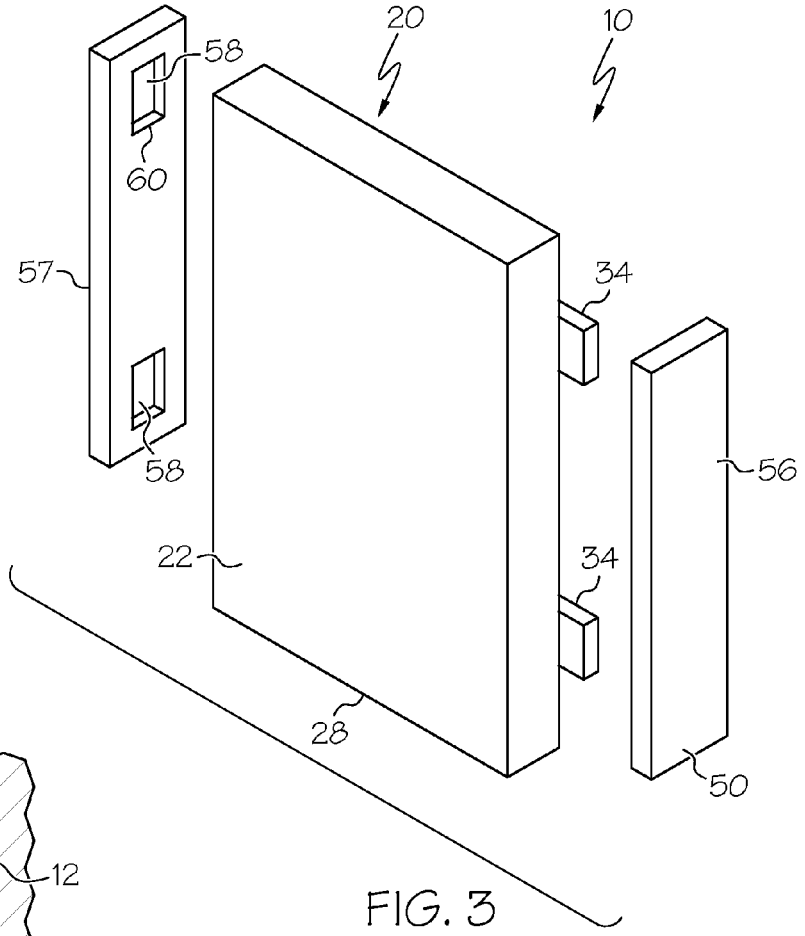
FIG. 3 shows another embodiment of an acoustic panel.
Figure 4:
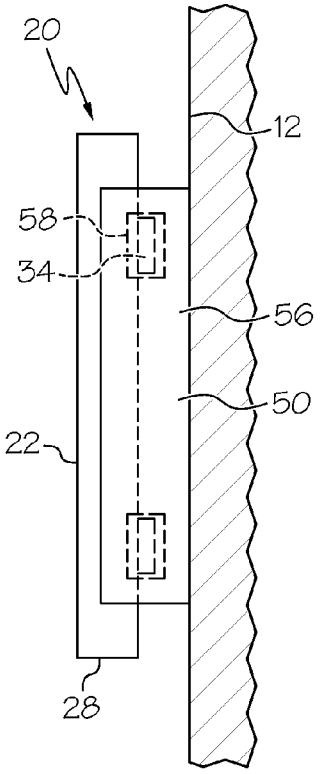
FIG. 4 shows a side view of the acoustic panel of FIG. 3.

FIGS. 3 and 4 show another embodiment of an acoustic panel 10. In some embodiments, the panel member 20 comprises a porous material core 28 and at least one structural member 34. Desirably, the core 28 is affixed to the structural member(s) 34 using any suitable method, such as fasteners, adhesive, etc.

In some embodiments, a mount 50 comprises brackets 56, 57 positioned on opposing sides of the panel member 20. In some embodiment, a bracket 56, 57 comprises a cavity 58 arranged to receive a structural member 34.

Desirably, the brackets 56, 57 are attached to a supporting surface 12, and the structural member(s) 34 are captively supported by the brackets 56, 57, allowing some freedom of movement of the porous material core 28 and structural member(s) 34 with respect to the brackets 56, 57.

The structural member(s) 34 can have any suitable shape and can be made of any suitable material. In various embodiments, structural member(s) 34 can comprise bars, rods, tubes, etc.

In some embodiments, a cavity 58 that receives a structural member 34 comprises a size dimension that is greater than a corresponding distance across the structural member 34, which can provide for the captive support discussed herein. In some embodiments, a cavity 58 comprises a flat bottom 60. In some embodiments, a cross-sectional shape of a cavity 58 can be similar to a cross-sectional shape of a structural member 34. In some embodiments, a cavity 58 and a structural member 34 have circular cross-sectional shapes.

Figure 6:
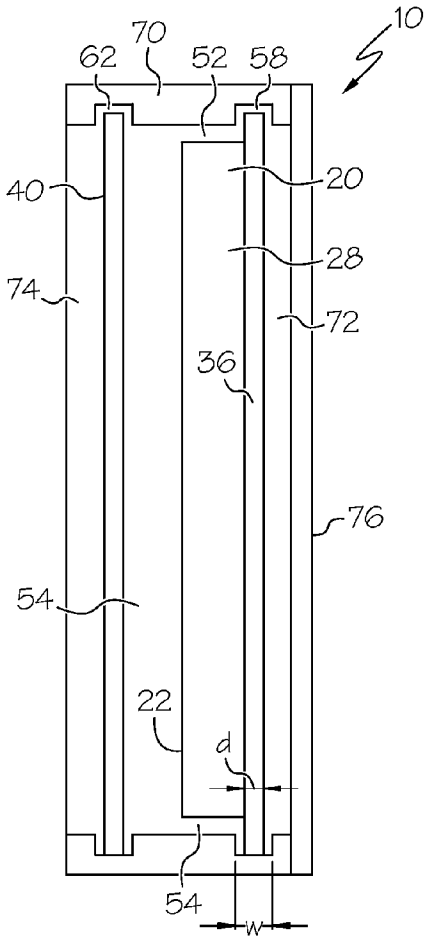
FIG. 6 shows a side sectional view of the acoustic panel of FIG. 5.
Figure 5:
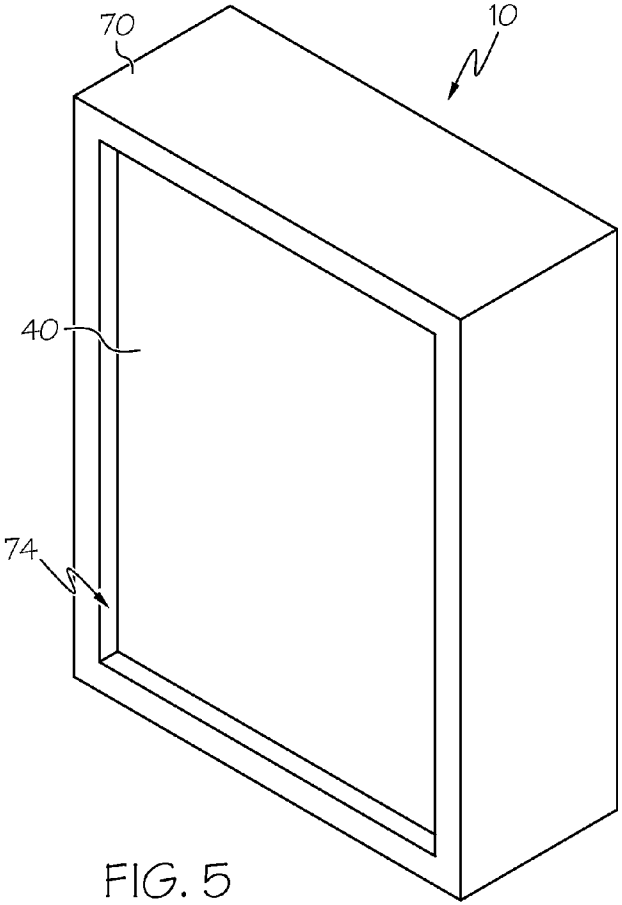
FIG. 5 shows another embodiment of an acoustic panel.
Figure 7:
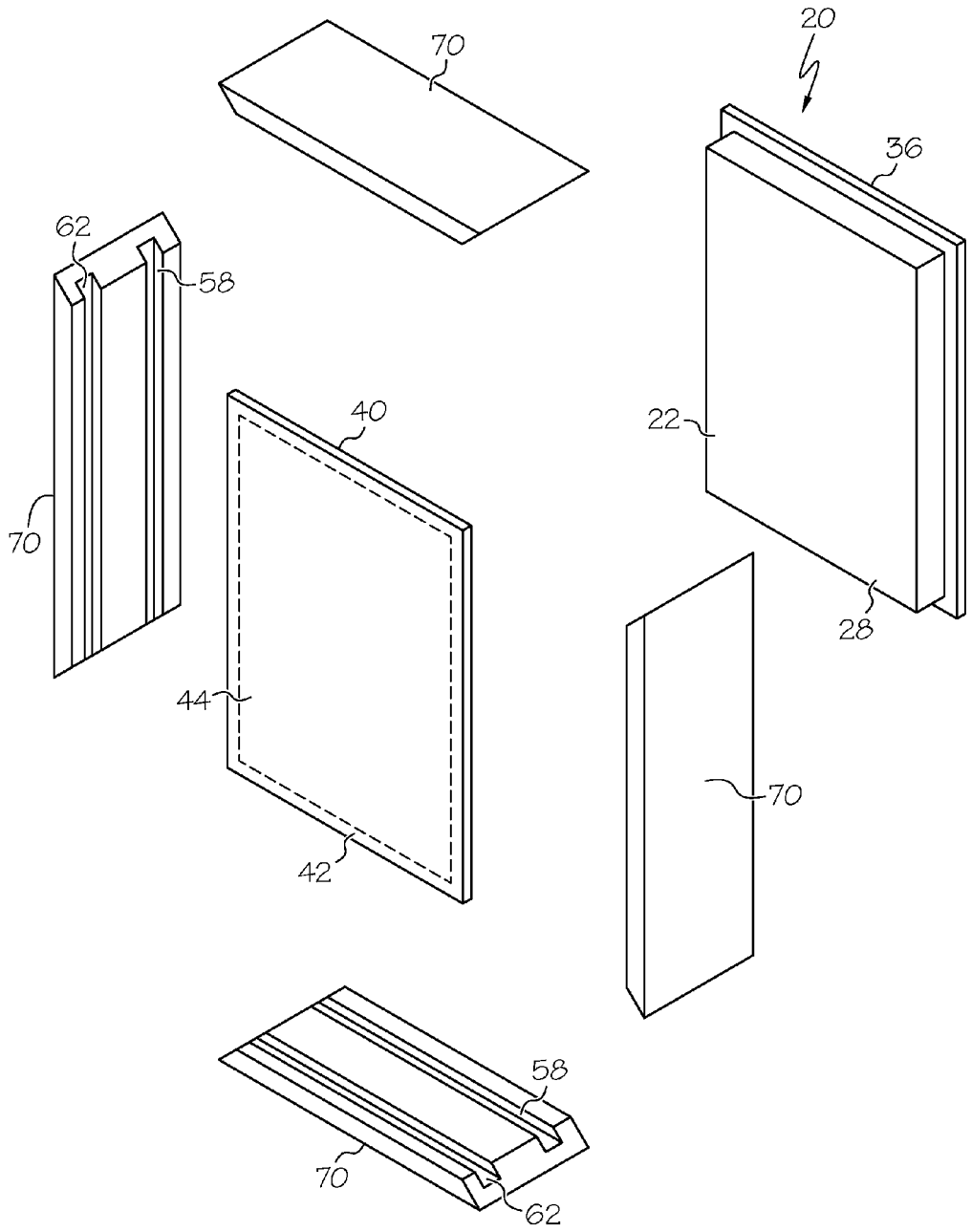
FIG. 7 shows an exploded view of the acoustic panel of FIG. 5.

FIGS. 5-7 show another embodiment of an acoustic panel 10. FIG. 5 shows a view of the device as it might be set on a floor or mounted to a wall. FIG. 6 shows a cross-sectional view of the acoustic panel 10. FIG. 7 shows an exploded view.

In some embodiments, an acoustic panel 10 comprises a frame 70. In some embodiments, the frame 70 defines an outer perimeter of the acoustic panel 10. In some embodiments, the frame 70 at least partially surrounds a panel member 20. In some embodiments, the frame 70 continuously and fully surrounds a panel member 20.

A frame 70 can be made from any suitable material, such as metal, plastics, wood, plywood, MDF, particle board, etc. In some embodiments, a frame 70 comprises a coating such as a laminate, veneer, formica, melamine, polymer coating, etc. In some embodiments, exterior/visible surfaces of the frame 70 comprise a coating. In some embodiments, visible portions of the frame 70 are covered by a shroud of any suitable material, such as plastic or metal. In some embodiments, material of the frame 70 adds to sound absorption. In some embodiments, the shape of the frame 70 provides a cavity 74 that adds to sound absorption.

A frame 70 can have any suitable shape. In some embodiments, a frame 70 is circular. In some embodiments, a frame 70 comprises a polygon shape. In some embodiments, a frame 70 comprises a rectangular shape. In some embodiments, a frame 70 comprises a pair of opposed sides, and a pair of opposed ends.

In some embodiments, the frame 70 defines an internal volume 54, and a panel member 20 is received in the frame 70. In some embodiments, a shape of the panel member 20 is similar to a shape of the frame 70.

Desirably, the frame 70 captively supports the panel member 20. In some embodiments, the frame 70 comprises a cavity 58 arranged to receive a portion of a panel member 20, and a portion of the panel member 20 is oriented in a cavity 58. In some embodiments, a cavity 58 comprises a channel formed in the frame 70. In some embodiments, a channel 58 is provided in two opposing sides of the frame 70 (e.g. left and right sides, or top and bottom). In some embodiments, a channel 58 extends continuously around the panel member 20.

In some embodiments, a dimension of the cavity 58 (e.g. w in FIG. 6) is greater than a depth d of a portion of the panel member 20 that is received in the cavity 58, which allows for some freedom of movement.

In some embodiments, the panel member 20 comprises a porous material core 28 attached to a plate 36. In some embodiments, the plate 36 is planar. The plate 36 can be attached to the porous material core 28 using any suitable method, such as an adhesive, fasteners, etc. In some embodiments, the dimensions of a plate 36 exceed the dimensions of the porous material core 28.

A plate 36 can be made from any suitable material, such as polymers, metals, card stock, corrugated cardboard, wood, composites, etc. Desirably, a plate 36 is relatively thin and also a stiff material, for example comprising a lightly damped material able to be excited by acoustic energy. In some embodiments, a plate 36 comprises styrene. In some embodiments, a plate 36 comprises plywood. In some embodiments, a plate 36 comprises MDF. A plate 36 can have any suitable thickness, and in some embodiments ranges from 1/16" thick to ½" thick. In some embodiments, the thickness of a plate 36 is less than a thickness of the porous material core 28, As previously discussed herein, an acoustic panel 10 that includes a captively supported panel member 20 comprising a porous material can act as both a porous material absorber and a vibrating panel absorber. By adding a frame 70 that defines a cavity 74 located in front of the panel member 20, the acoustic panel is also able to behave as a cavity absorber.

In some embodiments, the acoustic panel 10 includes an airspace 52 between a sidewall of the porous material core 28 and the frame 70. In some embodiments, the airspace 52 is provided adjacent to multiple sidewalls of the porous material core 28. In some embodiments, the airspace 52 is provided on all sides of the porous material core 28 (or continuously around its perimeter, for example if the embodiment is curved or circular).

In some embodiments, a scrim 22 layer is attached to a first surface of the porous material core 28 (such as a front surface) and a plate 36 is affixed to a second surface (such as a rear surface). In some embodiments, the first surface opposes the second surface. The addition of a scrim 22 layer allows the porous material core 28 to behave as if it has a greater thickness, thus reducing the size of the device.

The scrim 22 layer can be applied to any suitable surface of the porous material core 28. In some embodiments, only a front surface of the porous material core 28 comprises a scrim 22. In some embodiments, side surfaces and/or top and bottom surfaces are provided with a scrim 22. In some embodiments, a rear surface of the porous material core 28 is also provided with a scrim 22 layer.

In some embodiments, a frame 70 is arranged to provide a sealed cavity 72 located behind the panel member 20. In some embodiments, the frame 70 is provided with an open back, and attachment to a supporting surface (e.g. surface 12 in FIG. 2) provides for the cavity 72, wherein the supporting surface comprises a wall of the cavity 72. In some embodiments, the frame 70 comprises a closed back 76.

In some embodiments, an acoustic panel 10 further comprises a second panel member 40, and a mount 50 or frame 70 captively supports the second panel member 40. Accordingly, a mount 50 or frame 70 can include a second cavity 62 or channel arranged to receive a portion of the second panel member 40. A first cavity 58 or channel can be spaced any suitable distance from a second cavity 62 or channel. In some embodiments, a first channel 58 is approximately two inches from a second channel 62.

In some embodiments, a second panel member 40 can comprise any embodiment of a panel member 20 as described herein. In some embodiments, the second panel member 40 is different from a first panel member 20. In some embodiments, a second panel member 40 is substantially thinner and lighter than a first panel member 20.

Desirably, the specifics of the second panel member 40 will work to enhance performance of the acoustic panel 10. In some embodiments, the second panel member 40 will enhance performance of the acoustic panel 10 with respect to higher audible frequencies.

In some embodiments, a second panel member 40 comprises a structural frame 42 (see FIG. 7) and a layer of material 44 such as a cloth or fabric, woven or non-woven. The structural frame 42 can comprise any suitable material, such as wood, polymers, metal, etc. The layer of material 44 can comprise any suitable material, including materials traditionally used as speaker grille materials and/or considered to be acoustically transparent. In some embodiments, the material 44 comprises a perforated material, such as perforated metal. In some embodiments, speaker grill cloth is used as the layer of material 44, for example being wrapped around the structural frame 42 and secured thereto. In some embodiments, the layer of material 44 comprises a dimensional fabric made from natural or synthetic fibers. In some embodiments, the layer of material 44 comprises polyester having any suitable density. In some embodiments, the layer of material 44 comprises a fabric that is not considered to be acoustically transparent. In some embodiments, multiple layers of material 44 can be used in the second panel member 40, wherein a first layer comprises a different material from a second layer.

In some embodiments, a design can be printed on the front face of a second panel member 40. This can provide a design on the acoustic panel 10. In some embodiments, a layer of material 44 in the second panel member 40 comprises a texturized, woven polyester fabric, comprising fibers of 60 den or less.

Figure 9:
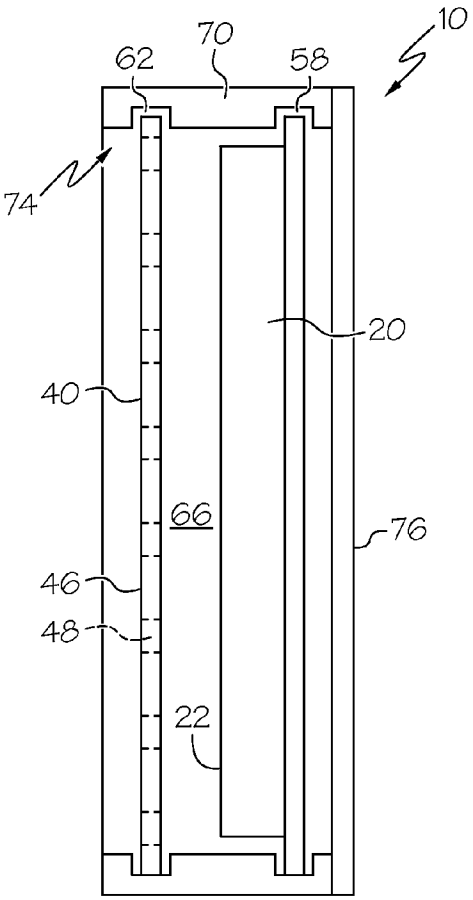
FIG. 9 shows a side sectional view of another embodiment of an acoustic panel.
Figure 8:
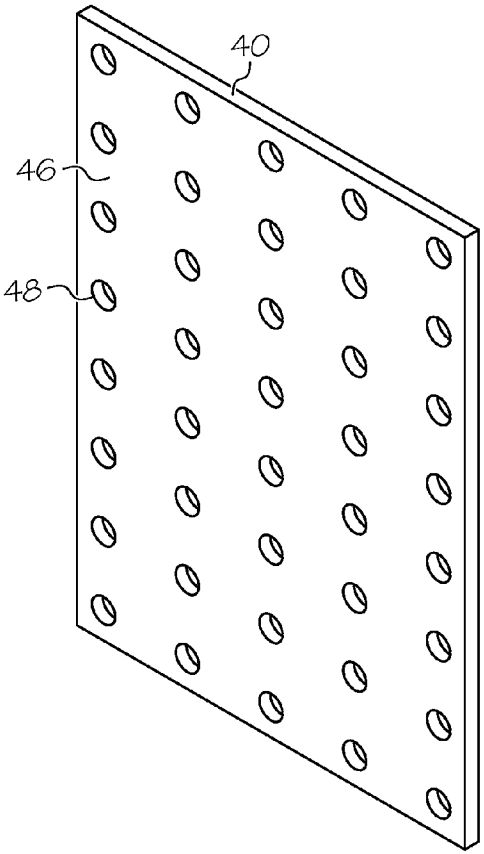
FIG. 8 shows an embodiment of a second panel member.

FIG. 8 shows another embodiment of a second panel member 40. FIG. 9 shows the second panel member 40 of FIG. 8 installed in an embodiment of an acoustic panel 10.

In some embodiments, a second panel member 40 comprises a solid material 46 having a plurality of openings 48 formed therein. The solid material 46 can comprise any suitable structural material, such as plastic, metal, wood, etc. In some embodiments, the openings 48 are provided at regularly spaced intervals. In some embodiments, a second panel member 40 comprises pegboard.

When a second panel member 40 comprising a solid material 46 having a plurality of openings 48 therein is used with a frame 70 that surrounds the acoustic panel 10, a chamber 66 is formed behind the second panel member 40 (see FIG. 9). The combination of a smaller opening 48 into a chamber 66 having dimensions that exceed the opening 48 creates a resonator (e.g. Helmholtz resonance). Thus, the provision of a second panel member 40 having a plurality of openings 48 and a chamber 66 behind the second panel 40 allows the acoustic panel 10 to also have resonator properties, in addition to comprising a porous material absorber and a vibrating panel absorber.

In some embodiments, an acoustic panel 10 comprises a front panel 80.

Figure 11:
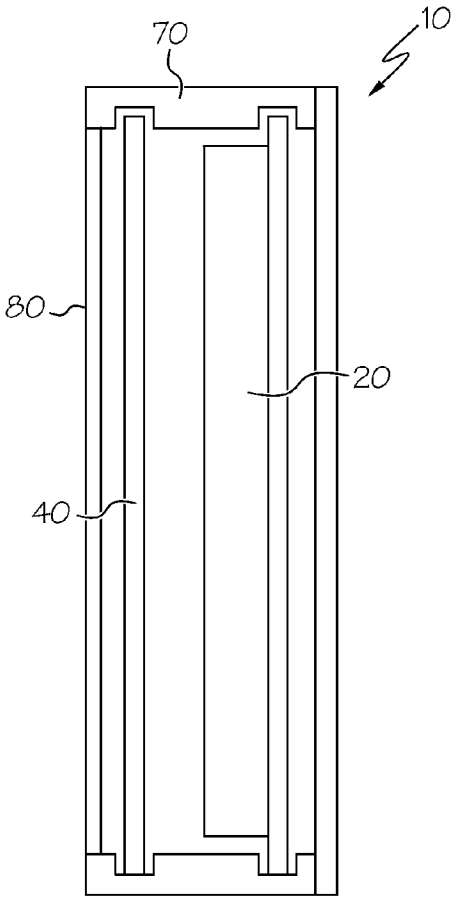
FIG. 11 shows a side sectional view of the acoustic panel of FIG. 10.
Figure 10:
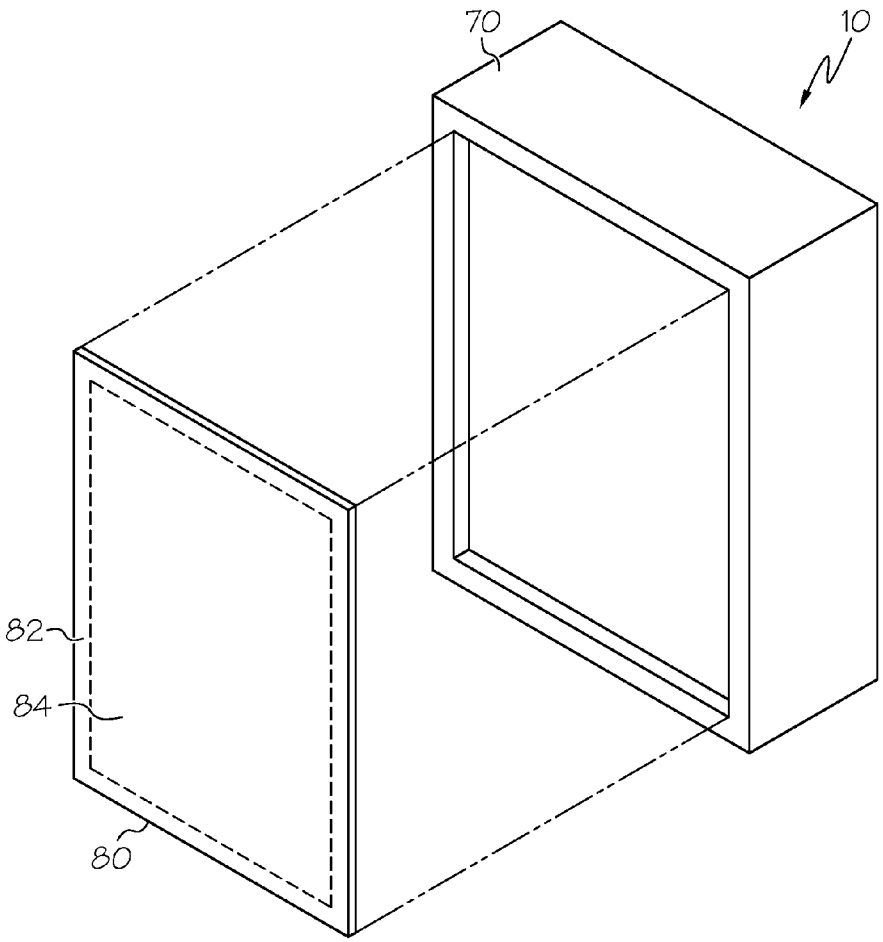
FIG. 10 shows another embodiment of an acoustic panel.

FIGS. 10 and 11 show another embodiment of an acoustic panel 10. The construction of the panel 10 is similar to the embodiment shown in FIGS. 5 and 6, but FIGS. 10 and 11 show an additional front panel 80. Desirably, the front panel 80 provides a pleasing appearance. A front panel 80 can be attached to the acoustic panel 10 using any suitable method, including the method(s) used for other panels (e.g. 20, 40). In some embodiments, a front panel 80 is friction-fit into the frame 70. Accordingly, in some embodiments, a front panel 80 is sized to be received by the frame 70. In some embodiments, a front portion of the front panel 80 is flush mounted with a front surface of the frame 70.

In some embodiments, a front panel 80 comprises a structural frame 82 of any suitable material and a layer of material 84 such as a cloth or fabric. In some embodiments, the material 84 is acoustically transparent. In some embodiments, an image is applied to the front panel 80, such as an image chosen by a customer. In some embodiments, sublimation dies can be used to imprint the image on the material 84 without substantially changing the acoustic properties of the material 84.

In some embodiments, an acoustic panel 10 is provided with multiple interchangeable panel members 20, wherein one panel member 20 is different from another panel member 20. For example, such panel members 20 can comprise porous cores 28 having different dimensions, porous cores 28 having different densities, porous cores 28 comprising different materials, etc. The panel members 20 can have differences in the structural members 34 or plates 36, for example having differing dimensions and/or materials. One panel member 20 can comprise a scrim 22 layer and another panel member 20 can omit a scrim 22 layer. Interchangeable panel members 20 allow a user to modify the specific acoustical properties of an acoustic panel 10.

Additionally, an acoustic panel 10 can be provided with multiple interchangeable second panel members 40 that comprise different materials or have differing acoustical properties. The provision of multiple interchangeable panel members 20 and multiple interchangeable second panel members 40 provides for several different combinations of specific acoustical properties.

An acoustic panel 10 can be provided with multiple interchangeable front members 80.

In some embodiments, multiple panel members 20 can be used in an acoustic panel on a given plane. For example, multiple panel members 20 can be placed side-by-side, stacked vertically, etc. Desirably, appropriate mounts 50 or frame 70 members are provided for each panel member 20.

In some embodiments, a panel member 20 can be suspended or hung from a mount 50 or frame 70, for example using tension cables. Desirably, the cables allow for some movement of the panel member 20 with respect to the mount 50 or frame 70, so as to be considered captively supported.

In some embodiments, a panel member 20 can be supported by a resiliently deforming member, such that the panel member 20 can move in response to acoustical energy via deformation of the resiliently deforming member. For example, one or more elastomeric mounts can be used to support the panel member 20. In some embodiments, an elastomeric diaphragm can be used to support the panel member 20. For example, a rubber panel having an aperture therein can be received in a frame 70, and the panel member 20 can be received in the aperture.

In some embodiments, a stand is provided, and one or more acoustic panels 10 are supported by the stand.

In some embodiments, the acoustic panel 10 can be manufactured in a clean room environment and sealed in a suitable delivery enclosure, such as a germ impervious polymer. Thus, the acoustic panel 10 can be used in environments that desirably remain as sterile as possible, such as a hospital.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An acoustic panel comprising:

a panel member comprising a structural member and a porous material, the structural member having a depth, the porous material having a depth, the panel member oriented vertically; and a mount suitable for attachment to a supporting surface, the mount comprising a lower portion oriented beneath the panel member, the panel member resting on the lower portion due to gravity, the mount defining a cavity, a portion of the structural member oriented in the cavity, a width of the cavity being greater than the depth of the structural member, said mount arranged to captively support said structural member such that said panel member is free to move with respect to said mount between first and second positions in response to acoustic energy, the first position displaced from the second position in a horizontal direction orthogonal to a front face of the panel member.

2. The acoustic panel of claim 1, said panel member comprising a scrim.

3. The acoustic panel of claim 2, wherein said scrim is attached to the front face of said porous material.

4. The acoustic panel of claim 3, wherein said porous material comprises side faces that do not have scrim material thereon.

5. The acoustic panel of claim 1, said mount comprising a frame that surrounds the panel member, said cavity comprising a channel formed in the frame.

6. The acoustic panel of claim 5, further comprising a front panel comprising a fabric.

7. The acoustic panel of claim 5, said channel extending continuously about an inner periphery of said frame member.

8. The acoustic panel of claim 1, said structural member comprising a planar plate.

9. The acoustic panel of claim 1, said mount comprising a first bracket and a second bracket, the first bracket comprising the lower portion, the second bracket oriented above said panel member.

10. An acoustic panel comprising:

a panel member comprising a porous material; and a frame member surrounding said panel member, said frame member comprising a lower portion oriented beneath said panel member, side portions and a top portion oriented above said panel member, said frame member having a front surface, said frame member comprising a channel that extends continuously about an inner periphery of said frame member;

wherein said panel member rests upon said lower portion due to gravity, a portion of said panel member is oriented in said channel and said frame member is arranged to captively support said panel member such that the panel member remains free to move with respect to the frame member in response to acoustic energy at least along an axis orthogonal to the front surface.

11. The acoustic panel of claim 10, wherein said support allows said panel member to move at least 1/16" with respect to said frame along an axis orthogonal to the front surface.

12. The acoustic panel of claim 10, said panel member comprising a structural member attached to said porous material, said frame captively supporting said structural member.

13. The acoustic panel of claim 10, said panel member comprising a scrim layer attached to said porous material.

14. The acoustic panel of claim 10, said frame member comprising a closed back.

15. The acoustic panel of claim 10, wherein said panel member is a first panel member, said acoustic panel further comprising a second panel member, said frame arranged to captively support said second panel member.

16. The acoustic panel of claim 15, wherein said second panel member is different from said first panel member.

17. The acoustic panel of claim 15, wherein said second panel member comprises a frame and a fabric.

18. An acoustic panel comprising:

a panel member comprising a porous material, a front face of said panel member oriented vertically; and a frame member surrounding said panel member, said frame comprising a channel, said frame member comprising a lower portion oriented beneath said panel member, said panel member resting upon said lower portion due to gravity;

wherein a portion of said panel member is disposed in said channel and a width of said channel is greater than a distance across said portion, said panel member free to move within said channel with respect to the frame member between first and second positions in response to acoustic energy, the first position displaced from the second position in a direction orthogonal to a front face of the panel member.

19. The acoustic panel of claim 18, said channel extending continuously about an inner periphery of said frame member.

20. The acoustic panel of claim 18, said frame member comprising a closed back.

* * * * *